United States Patent [19]

Hafner

[11] Patent Number: 4,817,876

[45] Date of Patent: Apr. 4, 1989

[54] ELECTROMAGNETICALLY ACTUATABLE VALVE, IN PARTICULAR FUEL INJECTION VALVE

[75] Inventor: Udo Hafner, Lorch, Fed. Rep. of Germany

[73] Assignee: Robert Bosch GmbH, Stuttgart, Fed. Rep. of Germany

[21] Appl. No.: 128,763

[22] Filed: Dec. 4, 1987

[30] Foreign Application Priority Data

Feb. 21, 1987 [DE] Fed. Rep. of Germany ..... 3705587

[51] Int. Cl.[4] ..... B05B 1/30

[52] U.S. Cl. ..... 239/585

[58] Field of Search ..... 239/585; 439/604, 606, 439/736

[56] References Cited

U.S. PATENT DOCUMENTS

| | | | |
|---|---|---|---|
| 3,914,003 | 10/1975 | Loy | 439/604 |
| 4,423,841 | 1/1984 | Palma | 239/585 |
| 4,423,842 | 1/1984 | Palma | 239/585 |
| 4,436,077 | 3/1984 | Hafner et al. | 123/472 |
| 4,476,423 | 11/1985 | Krauss et al. | 239/585 |
| 4,582,085 | 4/1986 | Hafner et al. | 239/585 |
| 4,583,804 | 4/1986 | Thompson | 439/736 |
| 4,643,359 | 2/1987 | Casey | 239/585 |
| 4,679,875 | 7/1987 | Ramsey | 439/604 |

*Primary Examiner*—Andres Kashnikow
*Assistant Examiner*—Karen B. Merritt
*Attorney, Agent, or Firm*—Edwin E. Greigg

[57] ABSTRACT

Contact pins of fuel injection valves are typically sealed off from the valve housing with sealing rings and provided with small plastic caps to protect them from an extruded plastic coating. The present invention simplifies this sealing. Accordingly, the housing includes axially aligned ducting bores with each ducting bore including a bore wall, each ducting bore of a valve housing is provided with at least two spaced bore grooves and each contact pin has at least two spaced contact pin grooves. Automatic sealing of the bores is attained by extrusion filling of the ducting bores and extrusion covering of the contact pins in the vicinity of the contact pin grooves based on the different temperature coefficients of the valve housing and plastic covering used.

5 Claims, 1 Drawing Sheet

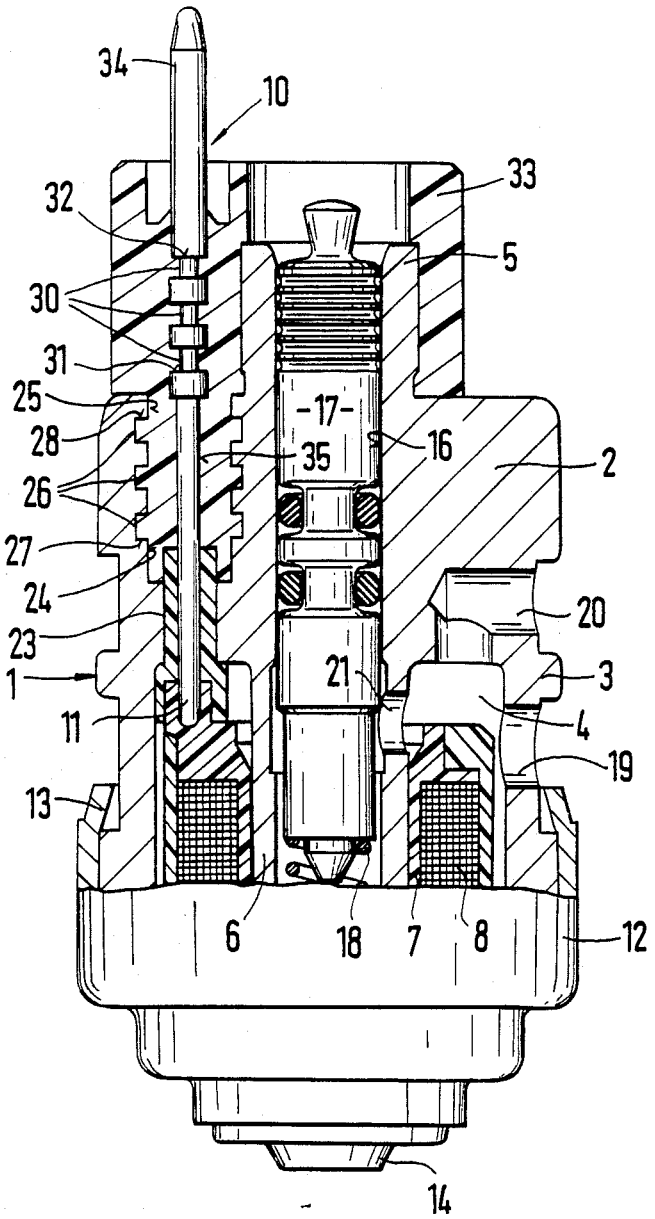
34
10
33
32
5
30
31
25
17
28
35
16
2
26
27
24
20
23
21
3
1
4
11
19
13
6
18
7
8
12
14

ELECTROMAGNETICALLY ACTUATABLE VALVE, IN PARTICULAR FUEL INJECTION VALVE

BACKGROUND OF THE INVENTION

The invention is directed to an electromagnetically actuatable valve. An electromagnetically actuatable valve is already known in which contact pins that extend out of the valve housing are sealed off from the valve housing by O-rings. To prevent damage to the O-rings when a plastic extrusion covering is applied, a small plastic cap must be placed over each O-ring prior to the application. Thus not only are additional parts in the form of the O-rings and small plastic caps necessary for assembling the valve, but they also entail additional labor.

OBJECT AND SUMMARY OF THE INVENTION

The valve according to the invention has an advantage over the prior art since it requires fewer parts, and its assembly is facilitated in a simple manner and hence made less expensive, while maintaining a required sealing at the contact pins.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows an exemplary embodiment of the invention in simplified form.

DESCRIPTION OF THE EXEMPLARY EMBODIMENT

The fuel injection valve for a fuel injection system, shown in the drawing, serves by way of example for injecting fuel, in particular at low pressure, into the intake tube of mixture-compressing internal combustion engines having externally supplied ignition. It includes a valve housing 1, which has a cup-shaped form having a bottom 2 and a tubular cylinder section 3. The bottom 2 and the cylinder section 3 define a blind-borelike interior 4 inside the valve housing 1. Remote from the interior 4 and beginning at the bottom 2, a guide connector 5 having a smaller diameter than the valve housing protrudes out of the valve housing 1, and a core 6, which like the valve housing 1 is made of magnetically conductive metal, protrudes in alignment with the guide connector 5 into the interior 4, beginning at the bottom 2. A coil carrier 7 having a magnet coil 8 is disposed in the interior 4, mounted on the core 6. The ends of the winding of the magnet coil 8 are each connected electrically to a respective electrically conductive metal contact pin on their end 11 protruding into the magnet coil 8. The interior 4 of the valve housing 1 is closed off, remote from the bottom 2, by a nozzle holder 12, which is mounted remote from the bottom 2 on the cylinder section 3 and secured thereon by means of a crimped edge 13. A nozzle body 14, by way of which the fuel injection is effected, is joined to the nozzle holder.

The guide connector 5, bottom 2 and core 6 are penetrated longitudinally by a guide bore 16, into which a slide member 17 is inserted and fixed with little play preferably by being wedged into place. A compression spring 18, which acts upon the armature (not shown) and the movable valve closing element of the fuel injection valve, is supported on the end of the slide member protruding into the core 6. The wall of the cylinder section 3 has a fuel inlet opening 19, extending in the radial direction, and above it a fuel outlet opening 20 that begins at the interior 4 and is extended through the bottom 2. Some of the fuel pumped via the fuel inlet opening 19 from a fuel supply source (not shown), such as a fuel pump, flows via the fuel inlet opening 19 around the magnet coil 8 in the direction toward the armature and the valve closing element and some fuel is throttled and flows in the direction toward the fuel outlet opening 20, in order to cool the fuel injection valve and return any dissolved vapor bubbles. Fuel not ejected via the nozzle body 14 can flow via the guide bore 16 toward the slide member 17 and via a radial opening 21 in the coil carrier back into the interior 4 in the vicinity of the fuel outlet opening 20, from which it can be returned via the fuel outlet opening to the fuel supply source.

The coil carrier 7 is provided with protrusions 23 oriented toward the bottom 2, which surround the end 11 of each contact pin and each of which, extending for instance parallel to the slide member 17, protrudes partway into a respective stepped ducting bore 24 in the bottom 2. Each contact pin 10 is connected to the ends of magnet coil 8 and extends through the ducting bore 25 and protrudes out from the bottom 2. Each ducting bore 24 has at least two bore grooves 26 in its bore wall 25. In the exemplary embodiment shown, three bore grooves 26 are provided, which are disposed spaced apart from and axially above one another and which for example have a rectangular cross section. Each bore groove is defined axially, by a lower edge 27 on its side oriented toward the interior 4 and by an upper edge 28 on its side remote from the interior. Each contact pin 10 also has at least two circumferential contact pin grooves 30 located outside the coating of the protrusion 23 and in particular outside the ducting bore 24. In the exemplary embodiment shown, three contact pin grooves 30 are provided, which are located one above the other and spaced axially apart from one another, and which have a bottom wall 31 oriented toward the interior 4 of the valve housing and a top wall 32 remote from the interior 4. The contact pin grooves 30 may advantageously have a rectangular cross section.

Remote from the interior 4, the bottom 2 of the valve housing 1 is surrounded with an extruded plastic covering 33, which encompasses the guide connector 5 and at the same time surrounds all of the protruding end of the contact pin 10 except for its free end 34 remote from the end 11; that is, this free end 34 protrudes out of the plastic covering 33 and serves to provide electrical contact with a mating plug, not shown, for connection to an electronic control unit. The plastic covering 33 likewise extends as far as the interior of each ducting bore 24, where it extends, beginning at the circumference 35 of the contact pin 10, as far as the bore wall 25 and inside each bore groove 26, filling these grooves. The described sprayed covering of the contact pins 10 and the sprayed filling of the through bore 24 with plastic assures reliable sealing off of the duct, required for electrical contact of the magnet coil, for the contact pins 10 through the valve housing 1, so that fuel from the interior 4 cannot reach the outside via the ducting bore 24 or along the surface of the contact pin 10, nor can air or moisture from outside get into the interior 4 of the valve. This sealing, which is assured at any operating temperature of the fuel injection valve, is based on the different temperature cooefficients of the valve housing 1, which is made of metal, and of the contact pins 10 and plastic covering 33. Since during the spray covering process, when the plastic covering 33 is produced, the plastic fills the ducting bore 24 having the bore grooves 26 at a high temperature, for example 180° C., and tightly surrounds the contact pins 10 having the contact pin grooves, the plastic comprising the plastic covering 33, as is well known, shrinks toward its volumetric center as it cools to room temperature, so that the plastic that fills the bore grooves 26 is pressed with tension and hence in a sealing manner against the upper edges 28 of the bore grooves 26, and the plastic in the contact pin grooves 30 shrinks toward the bottom walls 31 of the contact pin grooves 30, so that it presses sealingly against them, since in the cooling process the metal valve housing and the metal contact pins 10 contract to a lesser extent than does the plastic of the extruded plastic covering 33. If the metal valve housing 1 and the plastic covering 33 should heat up in response to a higher ambient temperature, or during operation of the fuel injection valve in the engine, then the result is a greater expansion of the plastic covering than of the material comprising the valve housing 1, and the sealing now changes because the plastic in the bore grooves 26 is now pressed sealingly against the lower edges 27 of the bore grooves, while the plastic in the contact pin grooves 30 presses against the top walls 32 of the contact pin grooves 30 and effects sealing. Thus the embodiment according to the invention allows automatic sealing of the ducts of the contact pins 10, without requiring additional sealing rings or small plastic caps.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An electromagnetically actuatable fuel injection valve for fuel injection systems in internal combustion engines, having a metallic valve housing, a core in said housing, a magnet coil which surrounds said core, electrically conductive contact pins that extend into said housing and protrude from said housing, said contact pins guided into the valve housing through ducting bores in said housing which form bore walls in said valve housing, each of said contact pins having inner ends electrically conductively connected to the ends of the winding of the magnet coil, an extruded plastic covering extending radially inside each ducting bore thereby surrounding said contact pins, said plastic covering beginning at a circumference of the contact pins within said bores and extending to said walls of said bores and extending to outside the valve housing surrounding said contact pins, each ducting bore (24) being provided with at least two bore grooves (26) in said bore wall (25), each contact pin (10) including at least two contact pin grooves (30) in the circumference, and the bore grooves (26) and the contact pin grooves (30) are filled with said extruded plastic covering (33).

2. A fuel injection valve as claimed in claim 1, in which said contact pins extend in parallelism with the axis of said valve housing.

3. A fuel injection valve as set forth in claim 1, which includes a coil carrier (7), said coil carrier includes at least one protrusion (23), said protrusion extends into said ducting bore which protrusion is surrounded with said extruded plastic covering, and each of said contact pins includes an end that extends into said protrusion extending from said coil carrier in which said contact pins are connected to the ends of the winding of the magnet coil.

4. A fuel injection valve as set forth in claim 1, in which said housing includes a guide connection (5) extending from one end, said ducting bores extend into said housing juxtaposed said guide connection, and said covering surrounds said guide connection.

5. A fuel injection valve as set forth in claim 3, in which said housing includes a guide connection (5) extending from one end, said ducting bores extend into said housing juxtaposed said guide connection, and said covering surrounds said guide connection.

* * * * *